US005112223A

United States Patent [19]

Walle et al.

[11] Patent Number: 5,112,223

[45] Date of Patent: May 12, 1992

[54] HOLLOW LOAD-BEARING UNIVERSAL KILN CAR REFRACTORY MODULES

[75] Inventors: Warren R. Walle, Gettysburg; Jack B. Ross, Biglerville; Jesse A. Hamilton, Gettysburg, all of Pa.; Delfin C. Martinez, San Pedro, N. Mex.

[73] Assignee: Dal-Tile Corporation, Dallas, Tex.

[21] Appl. No.: 664,405

[22] Filed: Mar. 4, 1991

[51] Int. Cl.[5] ..... F27B 9/26

[52] U.S. Cl. ..... 432/241; 432/137

[58] Field of Search ..... 432/241, 137, 141, 136

[56] References Cited

U.S. PATENT DOCUMENTS

| | | | |
|---|---|---|---|
| 1,521,216 | 12/1924 | Dressler . | |
| 1,587,210 | 6/1926 | Beecher et al. . | |
| 1,694,749 | 12/1928 | Moore et al. . | |
| 1,739,176 | 12/1929 | Morris et al. . | |
| 1,908,186 | 5/1933 | Robertson . | |
| 3,759,661 | 9/1973 | Barsby | 432/241 |
| 4,300,881 | 11/1981 | Salviati | 432/241 |
| 4,320,612 | 3/1982 | Jeffries, Jr. | 110/338 |
| 4,462,798 | 7/1984 | Foster | 432/241 |
| 4,578,031 | 3/1986 | Johnson et al. | 432/138 |
| 4,721,459 | 1/1988 | Fitz | 432/241 |
| 4,836,777 | 6/1989 | Elliott | 432/241 |
| 4,969,818 | 11/1990 | Ueda et al. | 432/241 |

*Primary Examiner*—Henry C. Yuen
*Attorney, Agent, or Firm*—Crutsinger & Booth

[57] ABSTRACT

The present invention relates to kiln car refractory furniture. In combination, (a) a kiln car having chassis that carries a platform; (b) a curb of a row of a plurality of hollow load-bearing refractory modules aligned along the periphery of the platform of the kiln car; and (c) an insulating amount of refractory insulation dispersed between the modules and laying over the platform of the kiln car. Each load-bearing hollow refractory module further comprises: (i) a hollow body formed of a refractory material having spaced walls and a top wall defining a hollow insulating space; (ii) at least one socket means for supporting a refractory post where the post in turn supports a load of refractory ware; (iii) a securing means for supporting the socket means spaced apart from the platform of the kiln car; and (iv) surfaces on the body adapted to interlock with surfaces on another abutting module. The modules may have an open bottom for passing refractory insulating material therethrough so that an insulating amount of refractory insulating material may be dispersed inside the hollow insulating space. The kiln car furniture modules may also have surfaces adapted to overlap with corresponding surfaces on an interior side wall of a tunnel kiln.

20 Claims, 4 Drawing Sheets

HOLLOW LOAD-BEARING UNIVERSAL KILN CAR REFRACTORY MODULES

TECHNICAL FIELD

The present invention relates to refractory kiln car furniture. Kiln cars convey ceramic ware and other refractory ware through tunnel kilns. The refractory kiln car furniture insulates the metallic body of the kiln car from the intense heat within the kiln. The refractory furniture also supports the load of refractory ware above the kiln car inside the kiln.

BACKGROUND OF THE INVENTION

A tunnel kiln makes it possible to fire large quantities of refractory ware by a continuous process instead of a batch process. The refractory ware is conveyed through the kiln on kiln cars. The chassis, wheels, and platform of kiln cars are made of metal. The kiln cars are mounted on a track system.

The heat within a refractory kiln is much greater than metals can withstand. The basic problem with kiln cars is how to insulate them from the intense heat within the kiln. Originally, this problem was solved by cementing together small blocks of refractory material on top of the kiln car.

There are several problems with this original solution. For example, when the blocks are exposed to the heat of the kiln, they expand. The cracks between the blocks also expand. Then the cement between the blocks and other debris falls down into the cracks. When the blocks emerge from the kiln and cool, they contract, but they cannot close the cracks because of the debris. After several kiln cycles, the refractory portion of the car must be rebuilt.

Dressler, U.S. Pat. No. 1,521,216, discloses large and massive refractory blocks instead of the smaller blocks that had previously been used. The larger blocks do not need to be cemented together because they are large enough to stay in place. Furthermore, the blocks are interlocking to maintain the blocks in lateral position as the kiln car moves along the track. The vertical cracks between a layer of lower blocks are covered with an overlapping layer of upper blocks. Finally, Dressler '216 teaches forming the blocks with small Cavities. The cavities may be filled with insulating material.

Since the Dressler '216 patent, the price of energy has increased tremendously. Heating these massive blocks of refractory material is a major source of heat loss. The kiln car must be cooled before it can be handled. It requires costly production time for massive refractory members to cool.

Barsby, U.S. Pat. No. 3,759,661, discloses a low thermal mass kiln car. The platform of the kiln car has a plurality of metal sockets. Thin walled refractory posts are removably inserted into the sockets. The posts support refractory tiles that provide an upper surface for placing the refractory ware. The load of refractory ware is supported by the plurality of thin walled refractory posts. The kiln car is insulated from the heat of the kiln by layers of low thermal mass insulation. The insulation is positioned so that the refractory posts may pass through the layers of low thermal mass insulation. The insulation layers are totally non-load-bearing. Furthermore, the insulation does not provide any lateral support to the posts.

Foster, U.S. Pat. No. 4,462,798, discloses a system of triangularly arranged posts for supporting refractory tiles in a stacked and spaced relationship. The tiles provide several stacked surfaces for placing refractory ware. A solid flat refractory base is laid over the platform of the kiln car. Massive pyramid shaped blocks (15Δ×15Δ base, 11Δ high) of solid refractory material are firmly cemented onto the refractory base such that the apexes of the blocks are arranged in a fixed triangular pattern. The space between the bases of the pyramid blocks to the tops of the pyramid blocks is completely filled with a refractory cement to ensure that the blocks cannot move. In other words, the pyramid blocks are almost completely covered with refractory cement. This forms a high thermal mass refractory base. Each pyramid block has a deep vertical socket (8Δ) through the apex of the block for receiving a thin walled support post. Foster '798 teaches that the system of posts must be rigidly interconnected to compensate for the movements of the kiln car. The tops of the posts are interconnected to hold them in firmly fixed relation.

Fitz, U.S. Pat. No. 4,721,459, discloses low thermal mass refractory kiln car furniture members. The hollow members are employed to confine low-mass insulation material onto the surface of the kiln car. They are arranged in parallel rows along the perimeter of the rectangular surface of the kiln car. The furniture members thereby define a rectangular volume having a base area almost as great as the surface platform of the kiln car and several inches high. The refractory members are modular. Only a few furniture members must be specifically tooled for a given size kiln car. Insulation material is placed inside the rectangular volume within the perimeter of the furniture members. Insulation is also placed inside the hollow refractory members. Sockets are formed in the platform of the kiln car so that refractory support posts may be removably received therein. The hollow refractory furniture members have holes in the tops so that the refractory support posts may pass therethrough to the sockets in the platform of the kiln car. The refractory furniture members are non-load bearing.

There are several problems with the prior art solutions to the problem of insulating the kiln car from the heat of the kiln. First, the support posts that support the refractory ware are in direct contact with the metal chassis of the kiln car. Secondly, the insulating efficiency needs to be improved by using lower thermal mass kiln car furniture. Thirdly, the posts that support the refractory ware must be placed in a particular fixed relationship to one another because the receiving sockets are part of the kiln car platform. Fourthly, at least a few members of the kiln car furniture must be specifically tooled for the specific dimensions of the kiln car.

Therefore, it is the general object of the present invention to provide hollow load-bearing universal refractory modules for kiln cars that solve these and other problems.

SUMMARY OF THE INVENTION

The present invention provides, in combination, (a) a kiln car having chassis that carries a platform; (b) a curb of a plurality of hollow load-bearing refractory modules aligned along the peripheral edges of the platform of the kiln car; and (c) an insulating amount of refractory insulation dispersed between the modules and laying over the rectangular platform of the kiln car. Each load-bearing hollow refractory module further comprises: (i) a hollow body formed of a refractory material having spaced walls and a top wall defining an insulating hollow space; (ii) a socket means adapted to receive and support a refractory post where the post in turn supports refractory tiles in a stacked and spaced relationship above the platform of the kiln car and a load of refractory ware placed on the tiles; (iii) means for securing the socket spaced above the platform of the kiln car; and (iv) surfaces on the module adapted to interlock with a surfaces on another abutting module. The load of refractory ware is carried by the kiln car through the tunnel kiln for firing.

It is a further object of the present invention to provide hollow load-bearing kiln car furniture modules for (1) confining an insulating amount of a refractory insulating material within the perimeter of the platform of a kiln car and (2) bearing a load of refractory ware. The kiln car furniture module comprises: (a) a body formed of a refractory material having spaced walls and a top wall defining a hollow insulating space; (b) socket means adapted to receive and support a refractory post; (c) means securing the socket means on the body such that the socket means is spaced apart from the platform of the kiln car; and (d) surfaces on the body adapted to interlock with at least one other abutting module. The refractory posts support tiles in a stacked and spaced relationship above the platform of the kiln car. A load of refractory ware is placed on the tile surfaces and carried by the kiln car through the tunnel kiln for firing.

The modules may have an open bottom for passing refractory insulating material therethrough so that an insulating amount of refractory insulating material may be dispersed inside the hollow insulating space of the body of the module. The kiln car furniture modules may also have surfaces adapted to overlap with corresponding surfaces on an interior side wall of a tunnel kiln. The socket means for supporting a refractory post further comprises: (i) spaced walls and a bottom wall formed on the top of the body of the refractory module that define a hollow cup or socket adapted to receive and support a refractory support post and (ii) a reinforcing wall adapted to provide additional support to the socket. The spaced walls of the socket provide lateral support to the refractory post. The bottom wall of the socket provides vertical support to the refractory post.

Further objects, features, and advantages of the present invention will be readily apparent to those skilled in the art upon reading the following detailed description of the invention.

DETAILED DESCRIPTION OF THE INVENTION

Figure 1:
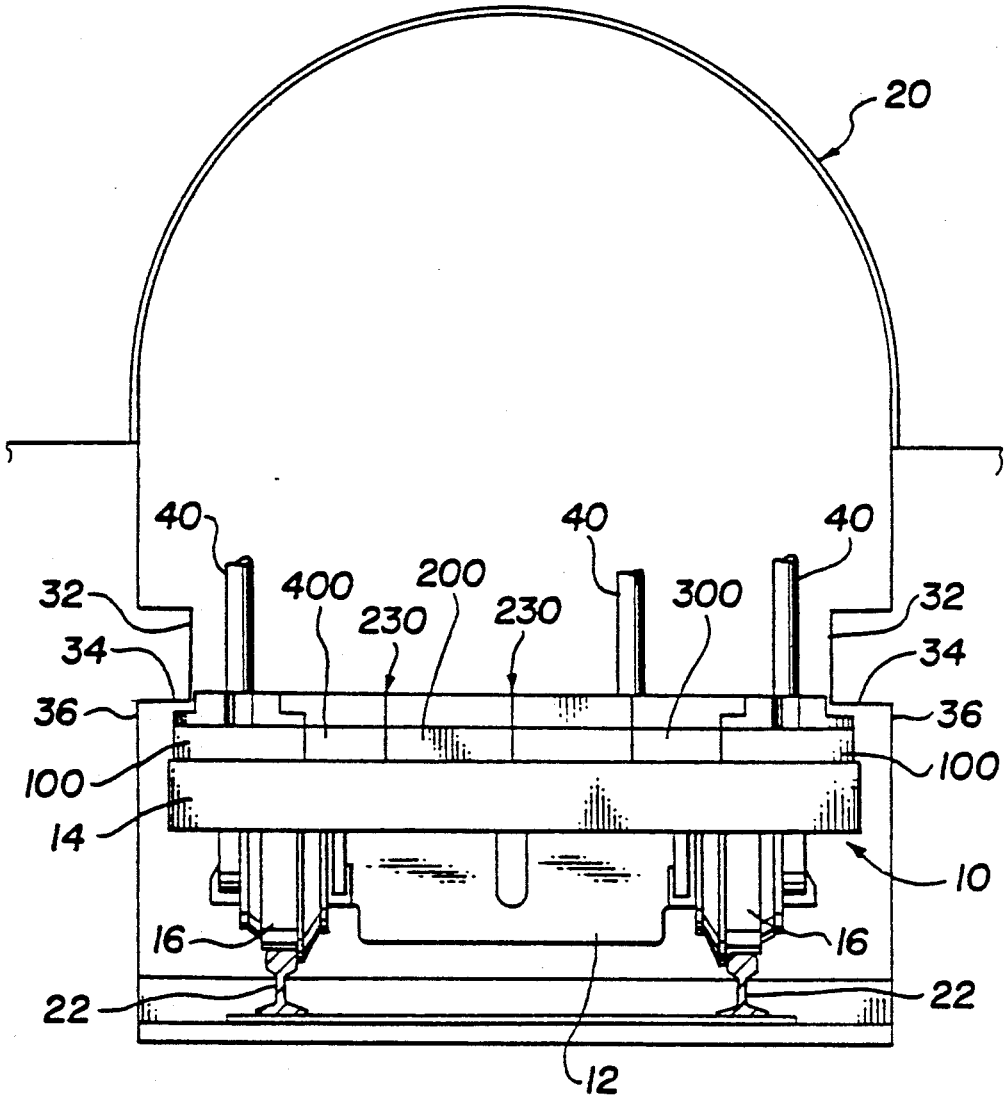
FIG. 1 is an elevation view of a kiln car in a tunnel kiln, the kiln car having hollow load-bearing universal kiln car refractory modules placed thereon and several support posts inserted into the refractory modules.

Referring now to FIG. 1 of the drawing, a kiln car is generally designated by the numeral 10. The kiln car 10 comprises the metallic chassis 12 and platform 14 of the kiln car 10. The kiln car 10 is traveling through a tunnel kiln, generally referred to by the numeral 20. The kiln car 10 has wheels 16 mounted on a track system 22. A typical kiln car 10 is on the order of about 5 (five) feet long and about 3 (three) feet wide.

For the purposes of the present description, the platform of the kiln car is assumed to be generally rectangular. However, the modules of the present invention could be adapted for kiln car platforms having different configurations. For the purposes of the present description, "longitudinal" refers to the direction of horizontal motion of the kiln car as it moves through the tunnel kiln. The longitudinal orientation is illustrated by line 52 in FIG. 2. The direction of line 52 arbitrarily indicates the direction of forward longitudinal motion of the kiln car 10. References to the right hand and left hand side of the car assumes one is facing the direction of forward longitudinal motion of the kiln car. "Transverse" refers to a perpendicular orientation relative to the longitudinal line of direction in the horizontal plane. The transverse orientation is illustrated by line 54 of FIG. 2.

The modules of the present invention are generally dome shaped. The modules have spaced walls and a top wall defining a hollow body. The edges of the spaced walls are adapted to rest on the platform 14 of the kiln car 10. For the purposes of the present description, all the modules are assumed to be placed in an upright position on the horizontal surface of the kiln car platform 14. When a module is placed in an upright position on the platform, the spaced walls and top wall of the module in contact with the platform define a chamber. There may be openings in the walls of the chamber, as will hereinafter be described in detail.

The "length" of a refractory module refers to the longest dimension of the module in the horizontal plane of the kiln car. The "width" of a refractory module refers to the shorter dimension of the module in the horizontal plane of the kiln car. Of course, the "height" or "depth" of a refractory module refers to the vertical height of the module when placed in an upright position on the kiln car. The base of a module refers to the part of the module that touches the platform 14 of the kiln car 10.

Figure 2:
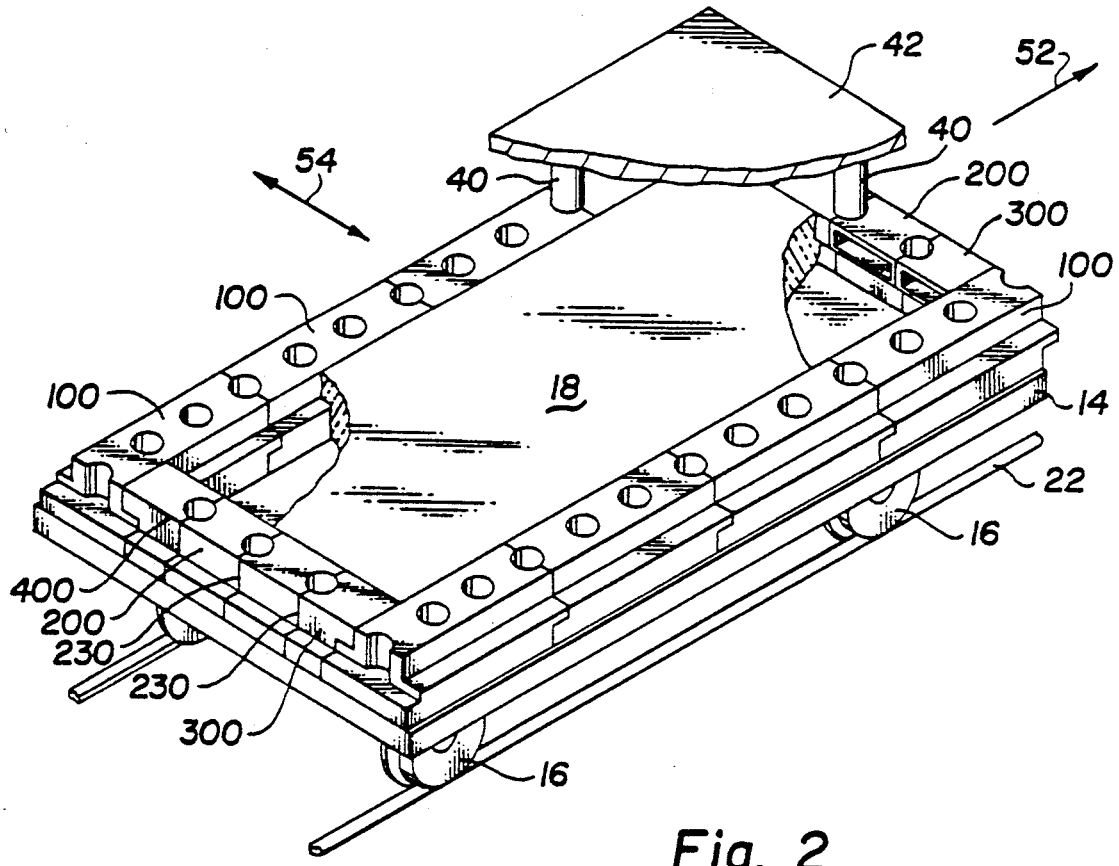
FIG. 2 is a perspective view of a kiln car having hollow load-bearing universal kiln car refractory modules placed thereon.
Figure 3:
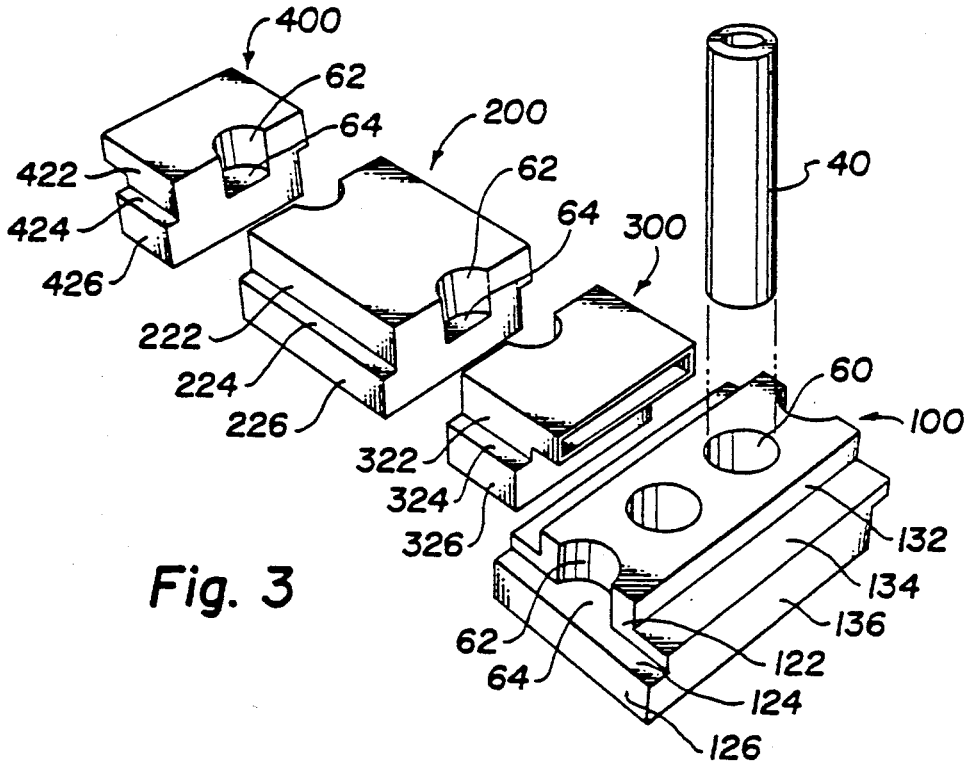
FIG. 3 is a perspective view of the modules in the upright position showing generally their structure and how they interlock.
Figure 4:
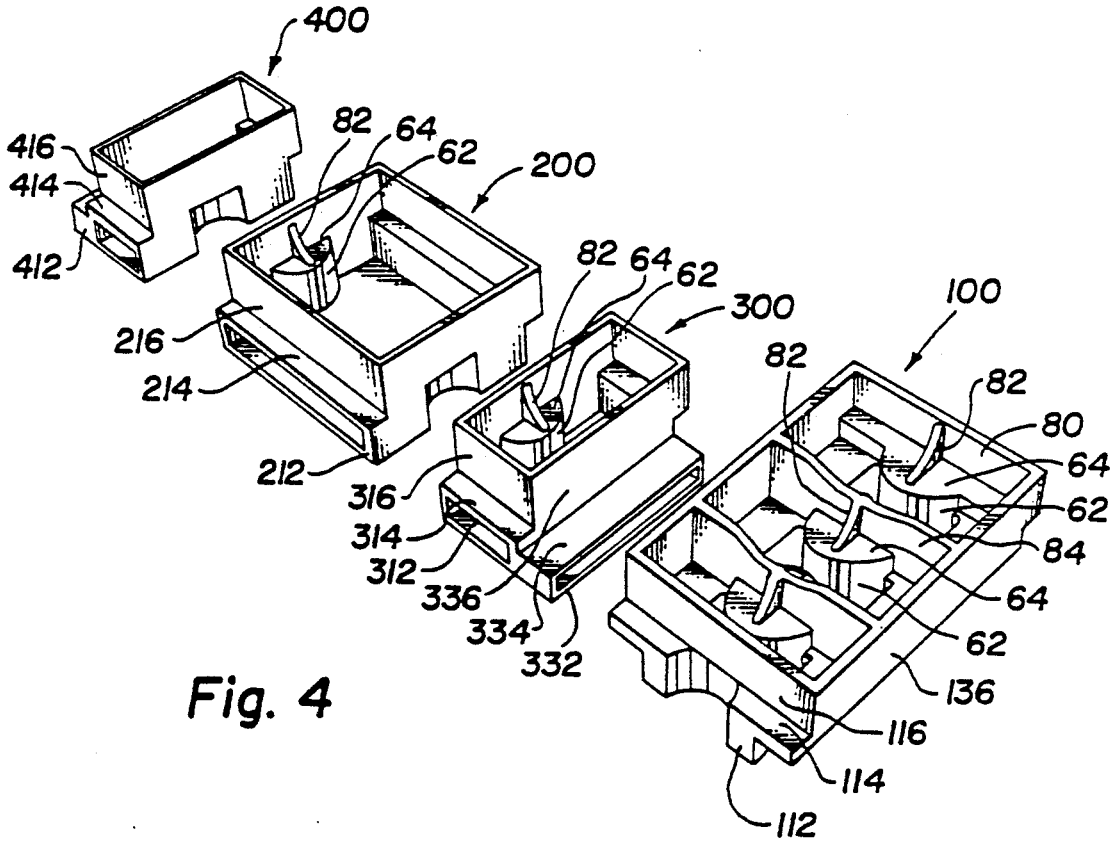
FIGS. 4 is a perspective view of the modules in the upside down position showing generally their interior structures.
Figure 5:
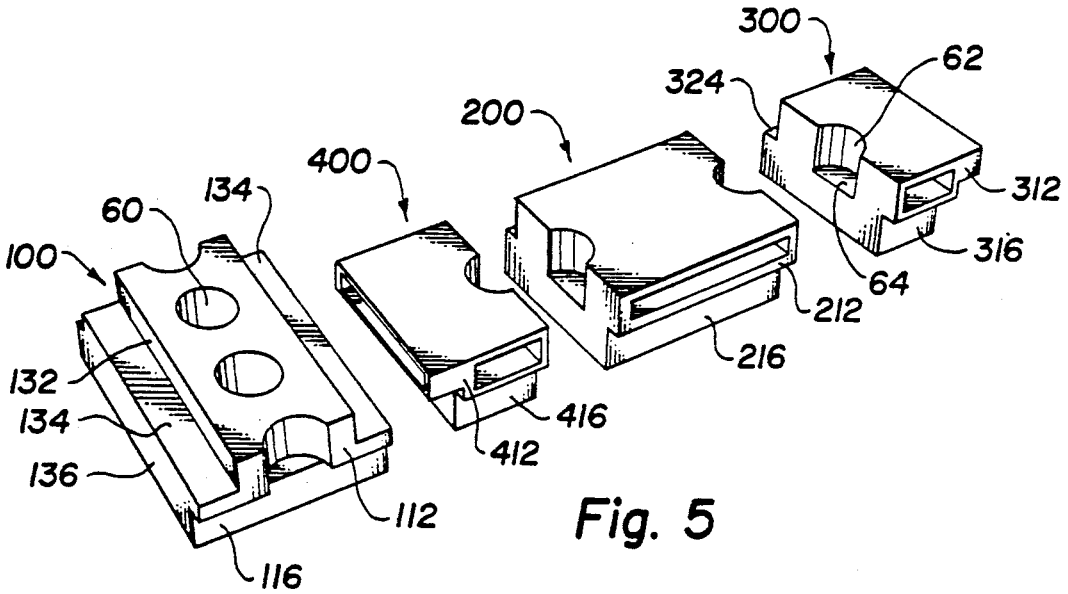
FIG. 5 is another perspective view of the modules in the upright position showing generally their structure and how they interlock.
Figure 6:
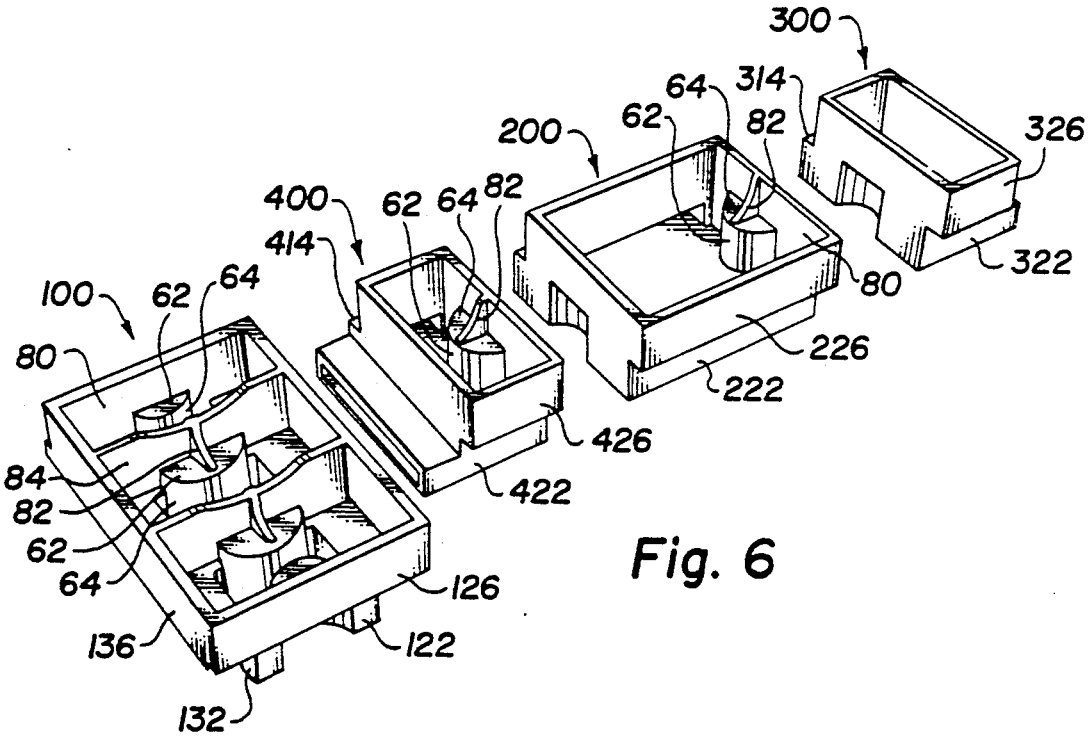
FIGS. 6 is another perspective view of the modules in the upside down position showing generally their interior structures.

FIGS. 1 and 2 generally illustrate a kiln car 10 having hollow load-bearing universal kiln car refractory modules 100, 200, 300, and 400 placed on the generally rectangular platform 14. All the modules are generally rectangular. The kiln car 10 has a curb comprising two rows of a plurality of modules 100 aligned along the opposite longitudinal edges of the rectangular platform 14 of the kiln car 10. The insulation 18 is contained on the platform 14 of the kiln car 10 between the curb of modules 100, 200, 300, and 400.

The modules 200, 300, and 400 shown in FIGS. 1 and 2 are optional. Modules 200, 300, and 400 are placed in two spaced, generally parallel rows of a plurality of modules aligned along the opposite transverse edges of the rectangular platform 14 of the kiln car 10. As will hereinafter be explained in detail, one of the purposes of modules 200, 300, and 400 is to insulate the space between the kiln cars. Modules 200, 300, and 400 also may be used to support additional refractory ware, as will be hereinafter explained in detail.

Referring now to FIGS. 3–6, the refractory modules 100, 200, 300, and 400 of the present invention are hollow. The nominal wall thickness is about ½ (one-half) inch. Depending on the load of refractory ware and the strength of the refractory material, the thickness of the wall could be reduced. Furthermore, it is also possible to form holes in the walls of the refractory modules. Reducing the thickness of the walls or forming openings in the walls would reduce the weight of the refractory modules. Reducing the weight would correspondingly reduce the thermal mass of the refractory modules, thereby reducing the heat loss to the refractory modules. The major limiting factor to reducing the mass of the refractory modules is the ability to support the weight of the refractory ware.

The bottom of the modules, i.e., the side that faces the platform 14 of the kiln car 10, may be open. The open bottom facilitates manufacture of the refractory modules. More importantly, the open bottom minimizes the thermal contact of the refractory modules with the platform 14. If the modules have an open bottom, refractory insulating material may be passed therethrough so that an insulating amount of refractory insulating material may be dispersed inside the hollow insulating space.

The socket 60 adapted to receive and support a refractory post comprises: (i) spaced walls 62 and a bottom wall 64 formed on the top of the refractory module that define a hollow socket 60 adapted to receive and support a refractory support post 40 and (ii) at least one reinforcing wall 80, 82, or 84 adapted to provide vertical support to the bottom wall 64 of the socket 60. All the circular recesses or sockets 60 shown in the modules of the present invention are approximately 1⅝ (one and five-eighths) inches radius. The socket 60 can receive a 3 (three) inch outer-diameter refractory support post 40. The bottom wall 64 should be able to support the refractory support post and a load of refractory ware. In another embodiment of the socket means of the present invention (not shown), the spaced walls could be upwardly extending from the top wall of the module and the bottom wall of the socket could be part of the top wall of the module or supported above the top wall of the module.

Reinforcing walls 80, 82, or 84 of the modules provide support the bottom wall 64 of the sockets 60. The reinforcing walls 80, 82, or 84 may be part of the spaced side walls of the module. The nominal thickness of the reinforcing wall 80, 82, or 84 is about ½ (one-half) inch. The reinforcing wall 80, 82, or 84 may be curved to provide the support of an arch to the bottom wall 64 of the socket 60. In a preferred embodiment, the reinforcing wall 80, 82, or 84 should have minimum direct contact with the platform 14 of the kiln car 10 so that thermal energy transfer from the refractory post through the module to the platform is minimized. Therefore, the interior reinforcing wall 84 of Module 100, for example, is curved to reduce contact with the platform 14 of the kiln car 10.

In one aspect of the present invention, the mating of the modules, for example, the modules 100, 200, 300, or 400 shown in FIGS. 3–6, may result in adjoining recesses providing a socket 60 in which a 3 (three) inch outer-diameter refractory support post 40 will fit. The advantage of forming a socket 60 by abutting two modules is that the bottom wall 64 of the socket 60 can be at least partially supported by at least one of the side walls of the module. For example, referring to FIGS. 4 and 6 of the drawing, the side wall forming the surface 116 on module 100 substantially supports half the bottom wall 64. The side wall forming the surface 126 on an abutting module 100 substantially supports the other half of the bottom wall 64. The arched reinforcing walls 82 provide additional support to the bottom wall 64 while minimizing contact with the platform 14 of the kiln car 10.

The support post 40 will normally be thin walled and hollow. The nominal wall thickness of the support post 40 is approximately ¾ (three-quarter) inches. Depending on the weight of the load of refractory ware and the strength of the refractory material, the wall thickness of the support post 40 could be reduced. The hollow support post 40 may optionally be filled with an insulating amount of insulation material. As best shown in FIG. 2, the posts 40 support refractory tiles 42 in a stacked and spaced relationship. The refractory tiles provide surfaces for placing refractory ware (not represented in the drawings) on the kiln car 10 for firing in the tunnel kiln 20.

The lap joint interlocks disclosed herein are preferred embodiments of the present invention. The interlock between the moving kiln car and the interior side walls of the tunnel kiln also must allow for the longitudinal motion of the kiln car through the tunnel kiln. However, the interlocks disclosed herein need not be of the exact profile shown; its design is at the discretion of the manufacturer except that it should not interfere with the surface on which the posts are to sit. Therefore, it is within the scope of the present invention to use, for example, tongue-in-groove joints between the refractory modules.

Referring to FIGS. 1 and 2 of the drawing, if desired, another row of modules 100 (not shown) can be aligned between the two rows of modules 100 on the longitudinal sides of the kiln car. Alternatively, another row of the modules 200, 300, and 400 (not shown) can be aligned between the two rows on transverse ends of the kiln car. The additional modules provide additional sockets for support posts 40 and additional insulation for the kiln car 10. The additional modules may be useful for very large kiln cars. The ability to place the modules anywhere on the kiln car platform allows for flexibility in the arrangement of sockets 60 for the refractory posts 40. Of course, additional modules increase the thermal mass of the kiln car.

The dimensions of the modules are sufficiently large to provide modules that are stable to the moderate movements of the kiln cars. The universal design of the modules of the present invention is suitable for the dimensions of most kiln cars in use today. Preferably, a few spacing modules with shorter lengths should be produced to ensure that the modules of the present invention will accommodate any kiln car. This will prevent the individual customer from having to purchase molds for specifically tooling any refractory modules. Specifically tooling refractory modules is very expensive.

The Design of Module 100

Referring now to FIGS. 3–6, module 100 has a length of 15¼ (fifteen and one-quarter) inches measured at its base. Module 100 has an overall length of 16¼ (sixteen and one-quarter) inches. Module 100 has a width of 10 (ten) inches measured at its base and an overall width of 10 (ten) inches. Th overall depth of the module is 6 (six) inches.

The length of module 100 is normally aligned parallel to the direction of longitudinal motion of the kiln car 10 represented by the line 52 in FIG. 2. Modules 100 are normally aligned in two spaced, generally parallel rows along the longitudinal sides of the rectangular platform 14 of the kiln car 10. The surfaces 112, 114, and 116 cooperate with surfaces 122, 124, and 126, respectively, to provide a lap joint interlock between the abutting modules 100 along the longitudinal sides of the kiln car 10.

For convenience, the surfaces 112, 114, and 116 are arbitrarily referred to as the head of the refractory module 100. Conversely, the surfaces 122, 124, and 126 are arbitrarily referred to as the tail of the refractory module 100. For convenience, the head of the module 100 is arbitrarily assumed to be oriented toward the direction of forward longitudinal motion of the kiln car 10.

The surfaces 112, 114, and 116 in cooperation with surfaces 122, 124, and 126, respectively, also provide a lap joint interlock between the abutting modules 100 on different kiln cars (not shown). Surfaces 112, 114, 116 and surfaces 122, 124, 126, respectively, of modules 100 may abut and contact one another on different kiln cars because the motion of two kiln cars relative to one another is moderate. In head-to-tail cooperation, these abutting surfaces help insulate the fore and rear transverse edges of the platform 14 of the kiln ca 10 and the chassis 12 of the kiln car 10 from the intense heat of the tunnel kiln 20. Ideally, there should be no direct crack or space communicating the heat of the kiln to the chassis 12 or the platform 14 of the kiln car 10.

Normally surfaces 132, 134, and 136 of the modules 100 make a lap joint alignment with corresponding surfaces 32, 34, and 36, respectively, protruding from the interior side walls of the tunnel kiln 20. See FIG. 1. Preferably, module 100 is symmetrical about a vertical plane cutting through the lengthwise middle of the module 100 so that the surfaces 132, 134, and 136 of module 100 may interact with either side of the interior surfaces 32, 34, and 36 of the tunnel kiln 20 regardless of whether the modules 100 are oriented in the head-to-tail direction or in the tail-to-head direction along the longitudinal edges of the kiln car 10. Thereby a left-handed and right-handed set of modules 100 would not be required if the surfaces 132, 134, and 136 on either lengthwise side of the module 100 could align with the protruding surfaces 32, 34, and 36 of the interior walls of the tunnel kiln 20.

Surfaces 132, 134, and 136 of modules 100 should not contact the surfaces 32, 34, and 36 protruding from the sides of the tunnel kiln 20 because the kiln car 10 must be able to move freely through the tunnel. In a preferred embodiment, the surfaces 134 of the kiln car module 100 are bevelled. A bevelled surface can tolerate more movement between the alignment of the kiln cars and the protruding surfaces 32, 34, and 36 on the interior wall of the tunnel kiln 20.

The lap joint alignment of surfaces 132, 134, and 136 with corresponding surfaces 32, 34, and 36, respectively, protruding from the interior walls of the tunnel kiln 20 narrows the gap between the edge of the kiln car 10 and the interior wall of the tunnel kiln 20. There should be no direct line of sight crack or space communicating the heat of the kiln 20 to the chassis 12 or platform 14 of the kiln car 10. In cooperation with the corresponding surfaces 32, 34, and 36 extending from the interior walls of the tunnel kiln 20, surfaces 132, 134, and 136 insulate the edges of the kiln car and the chassis of the kiln car 10 from the heat of the tunnel kiln 20. This lap joint alignment also minimizes the escape of heat energy from the tunnel kiln. This lap joint alignment also prevent debris from falling in the space between the longitudinal edges of the kiln car 10 and the sides of the tunnel kiln 20.

The Design of Module 200

Referring now to FIGS. 3–6, module 200 has a length of 12 (twelve) inches measured at the base of the module 200, and it also has an overall length of 12 (twelve) inches. Module 200 has a width of 10 (ten) inches measured at the base of module 200 and an overall width of 11 (eleven) inches. The overall depth of the module is 6 (six) inches.

The length of module 200 is normally aligned transverse to the direction of longitudinal motion of the kiln car represented by the line 54 in FIG. 2. Modules 200 are normally aligned in two spaced, generally parallel rows, one along the front edge and the other along the back edge of the rectangular platform 14 of the kiln car 10.

FIGS. 3–6 of the drawing show one embodiment of the module 200 in which the abutting modules 200 within the sam row transverse to the longitudinal motion of the kiln car do not interlock between themselves. As will be hereinafter described in detail, the module 200 could be advantageously modified to interlock between themselves within the same transversely oriented row.

The surfaces 212, 214, and 216 in cooperation with surfaces 222, 224, and 226, respectively, on module 200 provide a lap joint interlock in the longitudinal direction between the transversely oriented row of modules 200 on the back on one kiln car 10 and the transversely oriented row of modules 200 in the row on the front of another following kiln car 10 (not shown). Surfaces 212, 214, 216 and 222, 224, 226, respectively, may contact one another because the motion of two kiln cars 10 relative to one another is moderate.

For convenience, the surfaces 212, 214, and 216 are arbitrarily referred to as the head of the refractory module 200. Conversely, the surfaces 222, 224, and 226 are arbitrarily referred to as the tail of the refractory module 200. For convenience, the head of the module 200 is arbitrarily assumed to be oriented toward the direction of forward longitudinal motion of the kiln car 10.

In a preferred embodiment, the surfaces 214 and 224 of the modules 200 are bevelled. A bevelled union can tolerate more movement between the abutting kiln cars 10.

The lap joint interlock between the surfaces 212, 214, and 216 in cooperation with surfaces 222, 224, and 226, respectively, insulate the edges of the kiln car platforms 14 and the chassis 12 of the kiln cars 10 from the intense heat of the tunnel kiln 20. Except for the small longitudinal cracks 230 between the transversely abutting modules 20 in the same transverse row, best shown in FIGS. 1 and 2, there is no direct line of sight communication between the heat of the tunnel kiln 20 and the chassis 12 of the kiln cars 10. The lap joint interlock between kiln cars prevents heat from escaping from the tunnel kiln down between the front and back ends of the kiln cars. Escaping heat could damage the metallic chassis 12 of the kiln cars and the lubricants of the wheel mechanisms. Even if the escaping heat is not enough to damage the kiln cars, it is extremely wasteful of valuable energy resources.

The Design of Modules 300 and 400

Referring now to FIGS. 3-6, modules 300 and 400 are right and left hand mirror images of each other. Modules 300 and 400 have a length of 10 (ten) inches measured at the base of the module and an overall length of 11 (eleven) inches. Modules 300 and 400 have a width of 5 (five) inches measured at the base of the modules and an overall width of 7 (seven) inches. Finally, modules 300 and 400 have an overall depth of 6 (six) inches.

The widths of modules 300 and 400 are normally aligned transverse to the direction of longitudinal motion of the kiln car 10, represented by the line 54 in FIG. 2.

Modules 300 are normally aligned at the right hand end of a transverse row of modules 200. Module 300 abuts a module 200 and terminates the right hand side of a transversely oriented row of modules 200. Module 300 does not interlock with module 200. Surfaces 332, 334, and 336 of module 300 make a lap joint interlock with the surfaces 1 32, 134, and 136 of module 100.

Modules 400 are normally aligned at the left hand end of a row of modules 200. Module 400 abuts a module 200 and terminates the left hand side of a transversely oriented row of modules 200. Module 400 does not interlook with module 200. Surfaces 432, 434, and 436 of module 400 make a lap joint interlock with the surfaces 132, 134, and 136 of module 100.

With respect to module 300, surfaces 312, 314, and 316 in cooperation with surfaces 322, 324, and 326, respectively, on modules 300 provide a lap joint interlock in the longitudinal direction between the module 300 on the back of one kiln car 10 and the module 300 on the front of another following kiln car 10 (not shown). Surfaces 312, 314, 316 and 322, 324, 326, respectively, may contact one another because the motion of two kiln cars 10 relative to one another is moderate.

For convenience, the surfaces 312, 314, and 316 are arbitrarily referred to as the head of the refractory module 300. Conversely, the surfaces 322, 324, and 326 are arbitrarily referred to as the tail of the refractory module 300. For convenience, the head of module 300 is arbitrarily assumed to be oriented toward the direction of forward longitudinal motion of the kiln car 10.

With respect to module 400, surfaces 412, 414, and 416 in cooperation with surfaces 422, 424, and 426, respectively, on modules 400 provide a lap joint interlock in the longitudinal direction between the module 400 on the back of one kiln car 10 and the module 400 on the front of another following kiln car 10 (not shown). Surfaces 412, 414, 416 and 422, 424, 426, respectively, may contact one another because the motion of two kiln cars 10 relative to one another is moderate.

For convenience, the surfaces 412, 414, and 416 are arbitrarily referred to as the head of the refractory module 400. Conversely, the surfaces 422, 424, and 426 are arbitrarily referred to as the tail of the refractory module 400. For convenience, the head of the module 400 is arbitrarily assumed to be oriented toward the direction of forward longitudinal motion of the kiln car 10.

With respect to both modules 300 and 400, in a preferred embodiment, the surfaces 314, 324 and 414, 424, respectively, are bevelled. A bevelled union can tolerate more movement between the abutting kiln cars 10.

The lap joint interlock between the modules on different cars insulates the edges of the kiln car platforms 14 and the chassis 12 of the kiln cars 10 from the intense heat of the tunnel kiln 20. Except for the small longitudinal cracks 230 between the transversely abutting modules 200, 300, and 400 in the same row, there is no direct line of sight communication between the heat of the kiln and the chassis 12 of the kiln cars 10. The lap joint interlock between kiln cars prevents heat from escaping from the tunnel kiln down between the front and back ends of the kiln cars. Escaping heat could damage the metallic chassis 12 of the kiln cars and the lubricants of the wheel mechanisms. Even if the escaping heat is not enough to damage the kiln cars, it is extremely wasteful of valuable energy resources.

An Alternative Design of Modules 200, 300, and 400

In another preferred embodiment (not shown), the abutting modules 200 within the same transverse row can modified to interlock with one another in a lap joint manner similar to that hereinbefore described for the modules 100. If the module 200 is so modified, at least one of the modules 300 or 400 would also require modification so that it would be possible to interlock a module 300 or 400 with a module 200. The advantage of this modified design that provides for additional transverse interlocking between abutting modules within the same row is that the small longitudinal cracks 230 between the abutting modules 200 are eliminated.

It is to be understood of course that the foregoing description relates to the preferred embodiment of the present invention and that numerous modifications and alterations thereof may be made without departing from the spirit and the scope of the invention as set forth in the appended claims.

We claim:

1. In combination, (a) a kiln car having a chassis that carries a platform; (b) a row of a plurality of refractory modules aligned along the periphery of said platform; (c) an insulating amount of refractory insulation dispersed between said modules and laying over said platform; wherein each module comprises:

(i) a body formed of a refractory material having spaced walls and a top wall defining an insulating hollow space;

(ii) socket means for supporting a vertically extending refractory post where the refractory post supports a load of refractory ware;

(iii) means securing said socket means to said body such that said socket means is spaced from said platform; and (iv) surfaces on said body adapted to interlock with surfaces on another abutting module.

2. The combination of claim 1 wherein said socket means for supporting a refractory post comprises: spaced walls and a bottom wall defining a cup adapted to receive and support a refractory post.

3. The combination of claim 1 wherein said socket means for supporting a refractory post comprises: a first partial socket means at one end of said body and a second partial socket means at the opposite end of said body such that the first and second partial socket means form a complete socket means when two modules abut end-to-end.

4. The combination of claim 1 wherein said means securing said socket means on said body comprises: said body having spaced walls and a top wall of said module.

5. The combination of claim 1 wherein said means securing said socket means on said body comprises: a reinforcing wall supporting said socket means; and said body having spaced walls and a top wall of said module.

6. The combination of claim 5 wherein said reinforcing wall forms at least part of an arch so that thermal contact between said socket means and said platform is reduced.

7. The combination of claim 1, said surfaces of said modules configured to form lap joints between adjacent modules.

8. The combination of claim 1, said surfaces of said modules further adapted to overlap with a protruding surface on an interior side wall of a tunnel kiln.

9. The combination of claim 1 further comprising: an insulating amount of refractory insulation dispersed inside said hollow insulating space of said modules.

10. A thermal insulating apparatus positionable between the platform of a film car and a load of refractory ware, the thermal insulating apparatus comprising: a curb formed of modules positioned end to end around the periphery of the platform of the kiln car, each module having a curved end wall segment configured such that curved end wall segments of adjacent modules form a socket adapted to receive and support a vertically extending cylindrical refractory post spaced above the platform of a kiln car; and an insulating amount of refractory insulation dispersed over the platform of the kiln car within said curb of modules.

11. The thermal insulating apparatus according to claim 10, said curb comprising a plurality of modules having end to end surfaces configured to form lap joints between adjacent modules.

12. A kiln car furniture module for (1) confining refractory insulating material within he perimeter of a support surface of a kiln car and (2) being a load of refractory ware, the furniture module comprising:

(a) a generally dome shaped body formed of a refractory material having spaced walls and a top wall defining a hollow insulating space and having an open bottom for passing refractory insulating material therethrough;

(b) a socket means for supporting a vertically extending refractory post where the refractory post in turn supports a load of refractory ware;

(c) a means securing said socket means to said body such that said socket means is spaced from the platform of the kiln car; and (d) surfaces on said body adapted to interlock with surfaces on another abutting module.

13. The furniture module of claim 12 wherein said socket means for supporting a refractory post comprises: spaced walls and a bottom wall defining a cup adapted to receive and support a refractory post.

14. The furniture module of claim 12 wherein said socket means for supporting a refractory post comprises: a first partial socket means at one end of said body and a second partial socket mean at the opposite end of said body such that the first and second partial socket means form a complete socket mean when two modules abut end-to-end.

15. The furniture module of claim 12 wherein said means securing said socket means on said body comprises: said body having spaced walls and a top wall of said module.

16. The furniture module of claim 12 wherein said means securing said socket means on said body comprises: a reinforcing wall supporting said socket means; and said body having spaced walls and a top wall of said module.

17. The furniture module of claim 16 wherein said reinforcing wall forms at lest part of an arch so that thermal contact between said socket means and the platform is reduced.

18. The furniture module of claim 12, said surfaces of said modules configured to form lap joints between adjacent modules.

19. The furniture module of claim 12, said surfaces of said modules further adapted to overlap with a protruding surface on an interior side wall of a tunnel kiln.

20. The furniture module of claim 12 further comprising: an insulating amount of refractory insulation dispersed inside said hollow insulating space of said modules.

* * * * *

UNITED STATES PATENT AND TRADEMARK OFFICE

CERTIFICATE OF CORRECTION

PATENT NO. : 5,112,223

DATED : May 12, 1992

INVENTOR(S) : Walle et al.

It is certified that error appears in the above-identified patent and that said Letters Patent is hereby corrected as shown below:

In Column 1, line 45 change "Cavities." to -- cavities --. In Column 2, line 5 change "15△ X 15△ base, 11△" to -- 15" X 15" base, 11" --. In Column 2, line 14 change "(8△)" to -- (8") --. In Column 4, line 29 change "of" to -- or --. In Column 7, line 3 change "Th" to -- The --. In Column 7, line 31 change "ca 10" to -- car 10 --. In Column 8, line 62 change "modules 20" to -- modules 200 --. In Column 9, line 26 change "1 32" to -- 132 --. In Column 10, lines 20/21, there needs to be a space between lines 20 and 21 to indicate that line 20 is the heading for the following paragraphs. In Column 12, line 18 change "socket mean" to -- socket means --. In Column 12, line 20 change "socket mean" to -- socket means --.

Signed and Sealed this

Seventeenth Day of August, 1993

*Attest:*

Bruce Lehman

BRUCE LEHMAN

*Attesting Officer*

*Commissioner of Patents and Trademarks*